United States Patent [19]

Brooks

[11] 4,173,871

[45] Nov. 13, 1979

[54] REFRIGERATION APPARATUS DEMAND DEFROST CONTROL SYSTEM AND METHOD

[75] Inventor: Robert B. Brooks, Louisville, Ky.

[73] Assignee: General Electric Company, Louisville, Ky.

[21] Appl. No.: 864,972

[22] Filed: Dec. 27, 1977

[51] Int. Cl.[2] ..... F25D 21/00

[52] U.S. Cl. ..... 62/80; 62/155; 62/234

[58] Field of Search ..... 62/151, 155, 80, 234

[56] References Cited

U.S. PATENT DOCUMENTS

| | | | |
|---|---|---|---|
| 2,178,445 | 10/1939 | Warneke | 62/115 |
| 3,460,352 | 8/1969 | Lorenz | 62/153 |
| 3,498,073 | 3/1970 | Kusuda et al. | 62/155 |
| 3,518,841 | 7/1970 | West | 62/153 |
| 3,890,798 | 8/1974 | Fujimoto et al. | 62/155 |
| 3,992,895 | 11/1976 | Kramer | 62/155 |
| 4,056,948 | 11/1977 | Goodhouse | 62/155 |
| 4,123,915 | 11/1978 | Stoor | 62/234 |

*Primary Examiner*—William E. Wayner
*Assistant Examiner*—Harry B. Tanner
*Attorney, Agent, or Firm*—Frederick P. Weidner; Radford M. Reams

[57] ABSTRACT

A demand defrost control system which responds to whether a predetermined evaporator temperature is reached during a defrosting operation. If the predetermined temperature is not reached, then a relatively shorter interval before the next defrosting operation is established. If the predetermined temperature is reached, then a relatively longer interval before the next defrosting operation is established.

11 Claims, 2 Drawing Figures

REFRIGERATION APPARATUS DEMAND DEFROST CONTROL SYSTEM AND METHOD

CROSS-REFERENCE TO RELATED APPLICATION

The invention described and claimed herein is a form of a broader invention described and claimed in a copending application also entitled "Refrigeration Apparatus Demand Defrost Control System and Method," Ser. No. 864,971, filed Dec. 27, 1977, concurrently herewith, by Marvel A. Elliott and Donald L. Sidebottom, assigned to General Electric Company, the assignee of the present invention and now U.S. Pat. No. 4,156,350 issued May 29, 1979.

BACKGROUND OF THE INVENTION

The present invention relates to a demand defrost control system for a refrigeration apparatus.

Defrost controllers for automatically-defrosting refrigerators periodically interrupt operation of the refrigeration system and energize a heater to defrost the refrigerant evaporator. It has been recognized that maximum energy efficiency may be realized if the interval between automatic defrosting operations is varied according to actual need. Control systems which attempt to vary the interval between defrosting operations according to actual need are generally termed "demand defrost" systems. If successfully implemented, the result is energy savings with no decrease in performance.

One approach to a demand defrost system is to measure the actual amount of frost buildup on the refrigerant evaporator, and to initiate an automatic defrosting operation when the frost buildup becomes excessive. Systems attempting this approach have for example employed mechanical probes, photoelectric sensors, airflow impedance sensors, or sensors responsive to temperature differences between parts of the refrigeration system.

Direct measurement of frost buildup has proved to be difficult, and various predictive type demand defrost systems have been developed as an alternative. Predictive type systems have taken into account such parameters as ambient humidity, refrigerator door openings and accumulated compressor running time to predict the rate of frost buildup on the evaporator and thus the required time interval between successive automatic defrosting operations.

Any single predictive approach, such as taking into account ambient humidity, may by itself lead to significant inaccuracies. However, by combining several such approaches in a comprehensive system with appropriate weighting of their individual effects, good results may be obtained under most conditions of usage.

The present invention is one approach to a predictive demand defrost system. The invention may be used either by itself, or in combination with other approaches in a comprehensive system.

In one particular prior art defrost control system, there is a defrost control timer having a cam-operated switch. The cam and motor speed arrangement is such that the switch is in a normal position for approximately six hours of timing motor running time, and in a defrost position for approximately twenty minutes of timing motor running time. When the cam-operated switch is in a normal position, energization of the refrigeration system compressor occurs whenever called for by the refrigerator thermostat. In the defrost position, the refrigeration compressor is de-energized and a heater for defrosting the evaporator is energized. This particular prior art system additionally includes a thermal sensor which is responsive to a predetermined evaporator temperature, for example 50° F., being reached during a defrosting operation. When the predetermined temperature is reached, the heater is de-energized even though the cam-operated switch remains in the defrost position. In most cases, the predetermined temperature is reached before the end of the twenty-minute defrost duration period, and there is a period of time, known as defrost "dwell time," during which neither the refrigeration compressor nor the defrost heater is energized.

In this particular prior art defrost control system, the timing motor is connected to operate only when the refrigerator temperature control thermostat is calling for cooling and energizing the refrigerant compressor. Thus the defrost control timer effectively accumulates compressor running time (with the exception of periods during a defrosting operation when the thermostat is calling for cooling but energization of the compressor is prevented by the defrost control timer). This will be recognized as a form of predictive type demand defrost control system, taking into account the parameter of accumulated compressor running time.

SUMMARY OF THE INVENTION

Accordingly, it is an object of the invention to provide a predictive type demand defrost control system for a refrigeration apparatus.

It is another object of the invention to provide an approach to a demand defrost control system which may either stand alone or be employed in combination with one or more other approaches in a comprehensive demand defrost control system.

Briefly stated, and in accordance with one aspect of the invention, a refrigeration apparatus demand defrost system includes a defrost control including a means for establishing either a relatively shorter or a relatively longer interval between successive defrosting operations. A test is set up to determine whether each defrosting operation is successful, and the results of that test are used to determine the interval before the next defrost operation. If a defrosting operation is determined to be unsuccessful, then the relatively shorter interval before the next successive defrosting operation is selected. If, on the other hand, the defrosting operation is determined to be successful, then the relatively longer interval is selected.

More specifically, the defrost control includes a means for establishing the duration of a defrosting operation, during which duration the refrigeration system and the evaporator are de-energized. As in the one particular prior art defrost control system described above, a thermal sensor is responsive to a predetermined evaporator temperature being reached during a defrosting operation when the heater is energized. A means responsive to the thermal sensor selects the interval before the next successive defrosting operation. If the predetermined temperature is not reached during the duration of a defrosting operation, the relatively shorter interval is selected. If, on the other hand, the predetermined temperature is reached during a defrosting operation, the relatively longer interval is selected.

While particular design details may vary substantially for different refrigerator models, the following are given by way of example to point out the approximate time intervals, durations and temperatures involved. The relatively shorter defrost interval which occurs when a prior defrost is determined to be unsuccessful may be in the order of six hours. The relatively longer interval may be in the order of twenty-four hours. The duration of a defrosting operation is in the order of twenty minutes. Lastly, in one particular refrigerator model, the predetermined temperature is in the order of 50° F.

In one specific embodiment of the invention, the defrost control comprises two timer means. The first timer means is for establishing the relatively shorter interval and for establishing the duration of a defrosting operation. The second timer means is for establishing the relatively longer interval. The second timer means includes a means for preventing the energization of the defrost heater when the second timer means is running, and the means responsive to the thermal sensor includes a means for starting the second timer means whenever the predetermined temperature is reached. In operation, when the second timer means is inactive, the defrost interval control is under control of the first timer and the relatively shorter interval is established. If the predetermined evaporator temperature is reached during any defrosting operation, the second timer means is started. The relatively longer interval is thereby established and continues until the timing period of the second timer means is completed.

In another specific embodiment of the invention, the defrost control comprises a timer means for establishing the relatively shorter interval and for establishing the duration of a defrosting operation. Additionally, the defrost control comprises a recycling digital count accumulating means, such as a stepping switch, having a home condition in which energization of the defrost heater by the timer means is permitted, and at least one travelling condition in which energization of the heater is prevented. The timer means and the digital count accumulating means are interconnected such that so long as the digital count accumulating means remains in the home condition, the timer means periodically initiates defrosting operations with the interval between successive operations being the relatively shorter interval. To establish the relatively longer interval, the digital count accumulating means includes a means for incrementing the count accumulating means from the home condition to the first travelling condition whenever the predetermined temperature is reached during a defrosting operation. In this condition, whenever the timer means calls for a defrosting operation, the defrost heater is not energized. Rather, the count accumulating means is incremented from the first travelling condition to the next condition. The next condition may be either another travelling condition, or may be the home condition.

In accordance with the method aspect of the present invention, a method of controlling the interval between successive defrosting operations in a refrigeration apparatus includes the steps of establishing the duration of a defrosting operation; energizing a heater upon initiation of a defrosting operation and de-energizing the heater at least by the end of the defrosting operation; sensing the temperature of the evaporator during a defrosting operation; and selecting a relatively shorter interval before the next defrosting operation if a predetermined sensed temperature is not reached during a defrosting operation, and selecting a relatively longer interval before the next defrosting operation if the predetermined sensed temperature is reached during a defrosting operation.

BRIEF DESCRIPTION OF THE DRAWINGS

While the novel features of the invention are set forth with particularly in the appended claims, the invention, both as to organization and content, will be better understood and appreciated, along with other objects and features thereof, from the following detailed description taken in conjunction with the drawings, in which:

DETAILED DESCRIPTION OF THE PREFERRED EMBODIMENTS

Preliminarily, it should be noted that the particular embodiments described hereinafter utilize simple electromechanical elements, and are intended to illustrate the general concepts of the invention. The detailed description is not intended to limit the scope of the claimed invention. It will therefore be appreciated by those skilled in the art, that many alternative embodiments may be constructed, including embodiments partially or fully employing electronic circuitry.

While the present invention is applicable to the control of any refrigeration apparatus in which the evaporator is subject to frost buildup, it will be particularly described with reference to a refrigeration apparatus associated with a household refrigerator.

The specific type of refrigerator to which the present demand defrost control system is applied is the "frost-free" type which includes a refrigerant evaporator positioned in a chamber separate from the food storage compartments and which further includes a fan for circulating air over the evaporator. This general arrangement may be applied to refrigerators for fresh food storage, to freezers, or to combination refrigerator/freezers.

Figure 1:
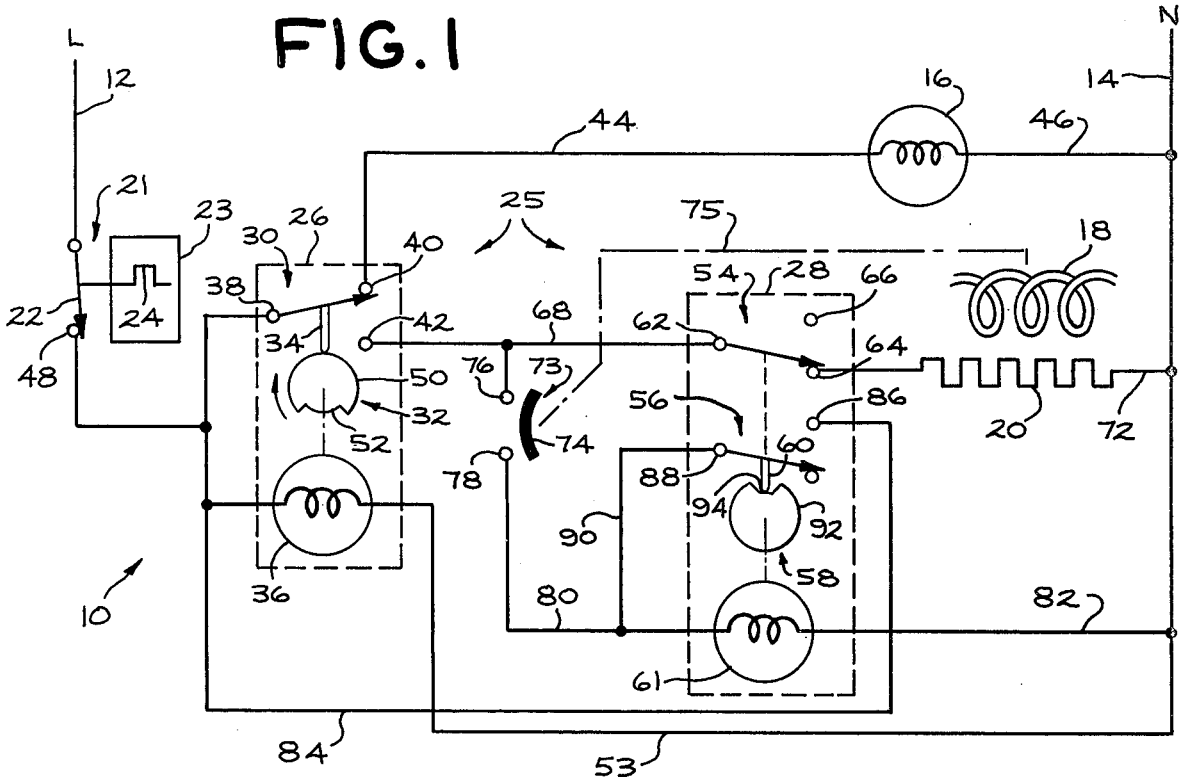
FIG. 1 is an electrical circuit diagram of a refrigerator control system according to one embodiment of the invention.

Referring now to the drawings wherein identical reference numerals refer to corresponding elements in both figures, FIG. 1 is an electrical schematic diagram of a refrigerator circuit 10 including one embodiment of the invention. L and N supply conductors 12 and 14 are supplied from a suitable source of AC power, for example a conventional power plug (not shown). Included as portions of a conventional closed circuit refrigeration system in the refrigerator are a refrigerant compressor motor 16 and a refrigerant evaporator 18. It will be appreciated that when the compressor motor 16 is energized, the evaporator 18 is thereby also energized by being supplied with liquid refrigerant.

In order to rapidly defrost the evaporator 18 when required, a heater 20 is provided. Preferably the heater 20 is of the radiant type and comprises an extended electrical heating element enclosed in a transparent quartz tube.

To control the temperature within the refrigerator by cycling the compressor motor 16 ON and OFF as required, as thermostatic control 21 in the form of a thermostatic control switch 22 is provided. The thermostatic control switch 22 closes when refrigeration is required to maintain a set temperature, and opens when refrigeration is not required. In FIG. 1, a box represents a refrigerated compartment 23 of the refrigerator. It will be appreciated that the compartment 23 is cooled by the evaporator 18 and that an element 24 of the thermal sensor 21 projects sufficiently into the compartment 23 to respond to the temperature therein. In the particular embodiment illustrated, the thermostatic control switch 22 is interposed directly in series with the L supply conductor 12. However, as will be pointed out below, other connections are possible.

In accordance with the present invention, there is provided a defrost control, generally designated 25. Generally speaking, the defrost control 25 includes means for establishing either a relatively shorter or a relatively longer interval between successive defrosting operations. The defrost control 25 further includes a means for establishing the duration of a defrosting operation.

The specific embodiments herein described include various timer means which, for convenience, are illustrated in highly schematic form and described as comprising cam-operated switches and timing motors. It is believed that the illustrated arrangements effectively show the functions of the timer means. It will be appreciated, however, that many different timer means are known and would be suitable in the practice of the present invention. For example, electronic timers operating on an RC time delay principle or including a clock pulse source and a digital counter may be employed. In the event a microprocessor based control is included in the refrigerator, the timing means may be an element of a suitably programmed microprocessor. Accordingly, there is no intention to limit the scope of the claimed invention to the embodiments illustrated.

More specifically, in the particular embodiment of FIG. 1, the defrost control 25 includes a first timer 26 for establishing the relatively shorter interval and for establishing the duration of a defrosting operation, and includes a second timer 28 for establishing the relatively longer interval.

The first timer 26 comprises a cam-operated switch 30 operated by a rotating cam 32 through a link 34. A timing motor 36 drives the rotating cam 32. The cam-operated switch 30 is of the single-pole, double-throw type having a movable contact terminal 38 and upper and lower fixed contact terminals 40 and 42, respectively.

The normal position for the cam-operated switch 30 is the upper position illustrated in which a connection is made between the movable contact terminal 38 and the upper fixed contact terminal 40. A conduction 44 supplies the refrigerant compressor motor 16 from the terminal 40. The compressor motor 16 also has a neutral return conductor 46 connected to the N supply conductor 14. A lower terminal 48 of the thermostatic control switch 22 is connected to the movable contact terminal 38. Thus when the cam-operated switch 30 is in the upper or normal position illustrated, the refrigeration compressor motor 16 and thus the refrigerant evaporator 18 are energized whenever the thermostatic control switch 22 closes.

Referring now more specifically to the timing motor and cam arrangement of the first timer 26, the rotating cam 32 may be seen to comprise a relatively larger diameter surface 50 which causes the link 34 to actuate the switch 30 to the upper position illustrated, and a relatively smaller diameter surface 52 which causes the link 34 to actuate the switch 30 to the lower position in which a connection is made between the movable contact terminal 38 and the lower fixed contact terminal 42. The speed of the timing motor 36 and the angular size of the relatively larger diameter cam surface 50 establish the first interval between successive defrosting operations. The timing motor speed and the relatively smaller diameter cam surface 52 establish the duration of a defrosting operation. Typically, the first interval between successive defrosting operations determined by the cam surface 50 is in the order of six hours, and the duration of a defrosting operation determined by the cam surface 52 is in the order of twenty minutes.

The timing motor 36 is energized from the L supply conductor 12 through the thermostatic control switch 22 whenever the thermostatic switch 22 is closed. To complete a circuit, the timing motor 36 has a neutral return conductor 53 connected to the N supply conductor 14. Due to this connection through the thermostatic control switch 22, the first timer 26 accumulates time only when the thermostatic control switch 22 is calling for cooling. Time accumulation when the thermostatic control switch is calling for cooling corresponds quite closely to compressor running time, the exception being that the thermostatic control switch 22 is generally calling for cooling during an automatic defrosting operation, during which the compressor motor 16 is not running. Thus, it will be apparent that the present demand defrost control system is included in the circuit 10 in combination with another type of demand defrost control system, specifically the type, mentioned in the Background of the Invention, in which a defrost interval timer accumulates compressor running time. By suitable circuit modifications described hereinafter, the present demand defrost control system may stand alone.

Considering now more specifically the second timer 28 for establishing the relatively longer interval, the second timer 28 includes a pair of cam-operated switch sections 54 and 56 driven by a rotating cam 58 through a link 60. A timing motor 61 drives the rotating cam 58.

The upper switch section 54 has a movable contact terminal 62 and a lower fixed contact terminal 64 which are connected when the switch section 54 is in the lower position shown. An upper fixed contact terminal 66 is not used in this particular circuit and may be omitted if desired. The movable contact terminal 62 is connected through a conductor 68 to the lower fixed contact terminal 42 of the switch 30. The lower fixed contact terminal 64 is connected through a conductor 70 to supply the defrost heater 20, which also has a neutral return conductor 72.

Thus, with the switch section 54 in the lower position illustrated, the defrost heater 20 is energized whenever the cam-operated switch 30 of the first timer 26 is in the lower defrost position, assuming also that the thermostatic control switch 22 is closed. So long as the cam 58 and the switch section 54 remain in the position shown, the compressor motor 16 and the evaporator 18 are periodically de-energized and the defrost heater 20 is periodically energized in response to the first timer 26.

The control system further includes a thermal sensor 73 in the form of a thermal switch 74 which is responsive to the temperature of the evaporator 18. Specifically, the thermal sensor 73 is responsive to a predetermined evaporator temperature being reached during a defrosting operation. The particular thermal switch 74 illustrated is a simple bimetallic switch positioned within the evaporator chamber attached to a portion of the evaporator 18. A dot-dash line 75 represents the thermal connection of the switch 74 with the evaporator 18. In this particular embodiment, the thermal switch 74 closes when the predetermined temperature is reached. A typical predetermined temperature is 50° F., although it will be appreciated that this may vary widely depending upon the particular refrigerator model and the precise location of the thermal switch 74 relative to the evaporator 18 and the heater 20.

An upper terminal 76 of the thermal switch 74 is connected to the lower fixed contact terminal 42 so as to be energized from the L supply conductor 12 when the cam-operated switch 30 is in the lower defrost position. A lower terminal 78 of the thermal switch 74 is connected through a conductor 80 to supply the timing motor 61. The timing motor 61 also has a neutral return conductor 82.

Thus, whenever the predetermined temperature is reached during a defrosting operation, the thermal switch 74 closes, energizing and thus starting the timing motor 61. The cam 58 immediately rotates and moves the switch sections 54 and 56 to their upper positions. This interrupts the connections through the terminals 62 and 64 to the defrost heater 20. Additionally, a latching circuit to maintain the timer motor 61 energized after it has been started is completed. The latching circuit includes a conductor 84 connected to the lower thermostatic switch terminal 48, an upper fixed contact terminal 86 of the lower switch section 56, a movable contact terminal 88, and a conductor 90. Once the timing motor 61 starts and the cam 58 rotates sufficiently to throw the switch section 56 to the upper position, energization of the motor 61 and rotation of the cam 58 continue until such time as the cam 58 rotates completely around to return the switch sections 54 and 56 to their lower positions.

Considering now the motor speed and cam arrangement of the second timer 28, the rotating cam 58 comprises a relatively larger diameter cam surface 92 and a relatively smaller diameter cam surface 94. In the particular embodiment illustrated, the relatively larger diameter can surface 92 holds the switch sections 54 and 56 in their upper positions for approximately twenty-four hours of timing motor running time. The relatively smaller diameter cam surface 94 returns the switch sections 54 and 56 to their lower resting positions for less than five minutes of timing motor running time. However, since the timing motor 61 is unenergized under most conditions, the illustrated lower position for the switch sections 54 and 56 is the usual position.

Considering now the overall operation of the embodiment of FIG. 1, it will first be assumed that there is a relatively large amount of frost buildup on the evaporator 18 such as would occur under high usage conditions with relatively high ambient humidity and frequent access door openings. Under such conditions, the defrost heater 20 is unable to raise the temperature of the evaporator 18 sufficiently to close the thermal switch 74 within the allowed twenty-minute defrost duration period. The first timer 56, and more specifically the cam-operated switch 30, cycles between the upper normal and the lower defrost positions, alternately energizing either the compressor motor 16 and the evaporator 18, or the defrost heater 20. During the interval between successive defrosting operations, the compressor motor 16 and the evaporator 18 are energized whenever called for by the thermostatic control switch 22. Since the supply to the timing motor 36 from the L supply conductor 12 is connected through the thermostatic control switch 22, the timer motor 36 and the cam 32 effectively accumulate compressor running time, and the interval between successive defrosting operations is six hours of accumulated compressor running time. Thus the relatively shorter interval between successive defrosting operations is selected.

Now assuming the frost buildup on the evaporator 18 is relatively light such as would occur under relatively low ambient humidity conditions, or with infrequent access door openings, or both, the predetermined 50° F. temperature is reached during defrosting operations and the thermal switch 74 closes. More specifically, a defrosting operation is initiated when the relatively smaller diameter cam surface 52 in the first timer 26 reaches the link 34, throwing the switch 30 to the lower position. The heater 20 is energized. Prior to the end of the twenty-minute defrost duration period, the thermal switch 74 closes. The timing motor 61 in the second timer 28 is energized and thus started. The lower switch section 56 continues the energization of the timer motor 61 for twenty-four hours of accumulated compressor running time, and the switch section 54 prevents the energization of the heater 20 all the while the second timer 28 is running. Thus the relatively longer interval between successive defrosting operations is selected.

In the circuit 10 of FIG. 1, it will be seen that during those extended intervals when the second timer 28 is running and energization of the heater 20 is prevented, nothing prevents the first timer 26 from de-energizing the compressor motor 16 for a period of twenty minutes every six hours. This is not believed to be particularly detrimental since a twenty-minute period is normally insufficient to cause excessive warming of the refrigerated space. However, if such interruptions of the compressor 16 are not desired, an additional conductor (not shown) may be added connecting the previously unused upper fixed contact terminal 66 of the switch section 54 to the conductor 44 supplying the compressor motor 16.

In the circuit 10 of FIG. 1, it will also be noted that all of the power to the circuit flows through the thermostatic control switch 22, and thus the timers 36 and 61 effectively accumulate time when the thermostatic switch 22 is calling for energization of the compressor motor 16 to provide cooling. If, however, it is desired to employ the present invention alone, not in conjunction with any other demand defrost approach, the thermostatic control switch 22 may be moved from its present location in the circuit and placed in series with the conductor 44 which supplies the compressor motor 16. The L supply conductor 12 would then be connected directly to the movable contact terminal 38, the timing motor 36, and the upper fixed contact terminal 86.

Figure 2:
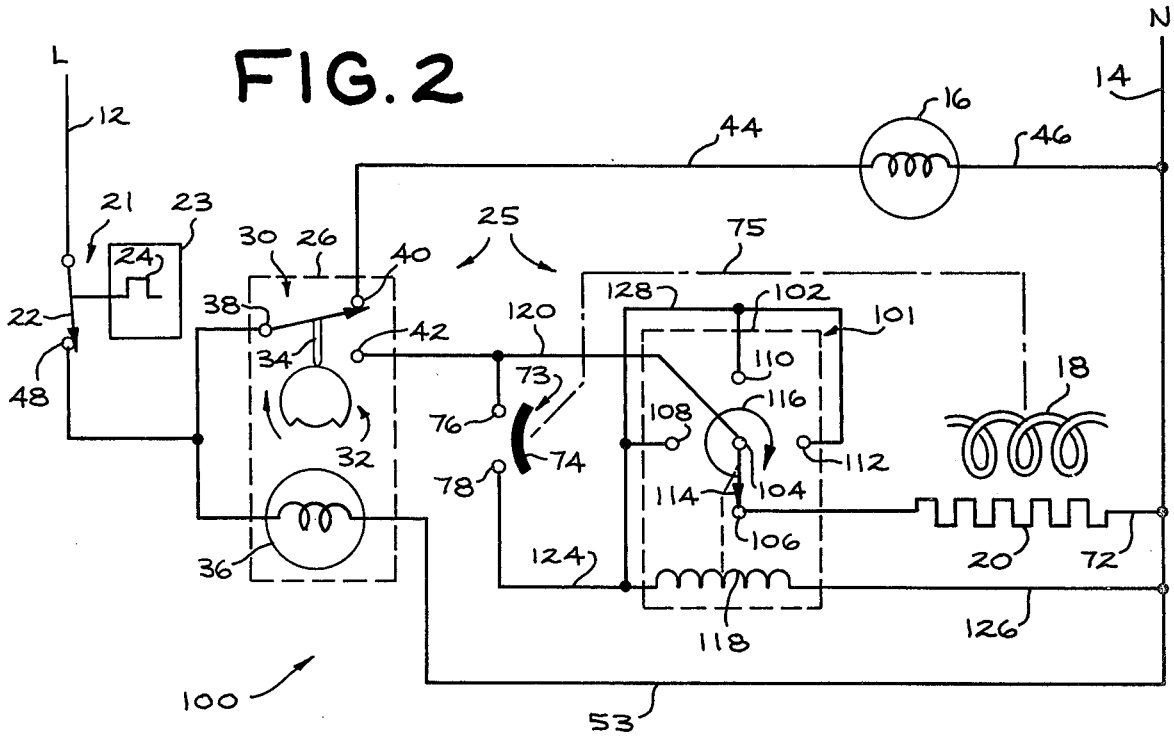
FIG. 2 is an electrical circuit diagram of a refrigerator control system according to another embodiment of the invention.

Referring now to FIG. 2 there is illustrated an electrical schematic diagram of a refrigerator circuit 100 including another embodiment of the invention. Certain elements in FIG. 2 bear reference numerals identical to reference numerals of corresponding elements of FIG. 1, and a detailed description thereof will not be repeated. For example, the defrost control 25 of FIG. 2 will be seen to comprise the timer 26 which establishes the relatively shorter interval and establishes the duration of a defrosting operation.

The defrost control 25 further comprises a recycling digital count accumulating means, generally designated 101. The digital count accumulating means 101 may be any device which may be incremented from one condition or state to the next, and which has a "home" condition or state to which it returns by cycling around. The particular digital count accumulating means 101 illustrated is a recycling stepping switch 102, sometimes referred to as a "sequencer". It will be appreciated that other devices may be employed, particularly electronic ones. For example, the digital count accumulating means 101 may comprise binary flip-flops arranged in a digital counter configuration such as a recirculating shift register configuration. As in the case of the timing means, the digital count accumulating means 101 may be an element of a suitably programmed microprocessor.

Referring to the specific embodiment, the recycling stepping switch 102 has a common terminal 104 and a plurality of successive contact terminals 106, 108, 110 and 112. The stepping switch 102 also has a rotating contact 114 which rotates in a clockwise direction as indicated by an arrow 116 a step at a time each time an electromagnetic coil 118 is energized. The stepping switch condition illustrated wherein the rotating contact 114 is connecting the common terminal 104 and the terminal 106 is herein termed the home condition. The three conditions of the stepping switch 102 which occur when the rotating contact 114 is connecting the common terminal 104 to each of the remaining terminals 108, 110 and 112 are herein termed travelling conditions.

In the connection of the stepping switch 102 to the remainder of the circuitry, the lower fixed contact terminal 42 of the timer 26 is connected through a conductor 120 to the common terminal 104, thus supplying the common terminal 104 whenever the cam-operated switch 30 is in the lower defrost position. To permit energization of the defrost heater 20 when the stepping switch 102 is in the home condition, the terminal 106 is connected through a conductor 122 to the defrost heater 20.

When the stepping switch 102 is in any of the travelling conditions, no power can be supplied to the contact terminal 106 and the conductor 122, and energization of the heater 20 is prevented.

In order to increment or step the stepping switch 102 from the home condition illustrated whenever the predetermined temperature is reached, the lower terminal 78 of the thermal switch 74 is connected through a conductor 124 to the stepping switch coil 118, which also has a neutral return conductor 126.

Lastly, to increment the stepping switch 102 from any travelling position to the next position whenever the timer 26 calls for a defrosting operation, the successive contact terminals 108, 110 and 112 are tied together by means of a conductor 128 and connected to the left-hand terminal of the coil 118 along with the conductor 124.

Considering now the operation of the embodiment of FIG. 2, under relatively heavy frost buildup conditions when the temperature of the evaporator 18 as sensed by the thermal switch 74 does not reach the predetermined temperature during defrosting operations, control of defrosting operations exclusively under control of the timer 26 results, with the relatively shorter interval between successive defrosting operations being established. So long as the stepping switch 102 remains in the home condition illustrated the connection from the lower fixed contact terminal 42 of the timer 26 through the stepping switch 102 to the defrost heater 20 remains uninterrupted.

Under relatively light evaporator frost buildup conditions, the predetermined temperature is reached during a defrosting operation, causing the thermal switch 74 to close. Since the cam-operated switch 30 of the timer 26 is in the lower defrost position during a defrosting operation, power is supplied through the conductor 124 to the coil 118, incrementing the stepping switch 102 to the first travelling condition in which the rotating contact 114 contacts the terminal 108. At this point, the defrost heater 20 is de-energized and further energization of the heater 20 is prevented. Upon completion of the defrost duration interval, the cam-operated switch 30 returns to the upper normal position, again permitting energization of the compressor motor 16 and the evaporator 18 whenever called for by the thermostatic control switch 22.

Thereafter, when the timer 26 again calls for a defrosting operation by throwing the cam-operated 30 to the lower defrost position, energization of the compressor motor 16 and the evaporator 18 is interrupted. However, energization of the heater 20 is prevented. Thus a defrosting operation does not occur. However, the stepping switch 102 is incremented from its travelling condition to the next condition by the connection through the conductor 120, the rotating contact 114, the terminal 108, and the conductor 128 to the coil 118.

This action continues for the next three times the timer 26 calls for a defrosting operation. Finally, the rotating contact 114 moves from the terminal 112 back to the home condition at which it contacts the contact terminal 106. At this point, the stepping switch 102 is ready to permit energization of the heater 20, which occurs immediately.

Thus the stepping switch 102 effectively accumulates defrost commands from the timer 26 while preventing actual energization of the heater 20, thereby extending the interval between successive defrosting operations.

In the particular embodiment of FIG. 2, the relatively longer interval is three times the length of the relatively shorter interval established by the timer 26 because they are three travelling conditions of the stepping switch 102. If the timer 26 is designed to call for a defrosting operation after every six hours of accumulated compressor running time, then the relatively longer interval between successive defrosting operations is eighteen hours. However, it will be appreciated that any desired multiple may be achieved simply by providing a different number of contact terminals on the stepping switch 102.

In a similar manner to that described above with reference to FIG. 1, if it is desired to continue operation of the compressor motor 16 during those times when the stepping switch 102 is in one of the travelling positions and the timer 26 is calling for a defrosting operation, a connection (not shown) may be made in FIG. 2 between the conductor 128 and the conductor 44 to energize the compressor motor 16 and thus the refrigerant evaporator 18. Further, in the event it is desired that the timer motor 36 should accumulate real time, rather than time during which the thermostatic control switch 22 is calling for cooling, the thermostatic control switch 22 may be removed from its illustrated position in series with the L supply conductor 12, and connected in series with the conductor 44 supplying the compressor motor 16.

From the foregoing, it will be apparent that the present invention provides demand defrost control systems which, to determine the interval before the next successive defrosting operation, utilize the criterion of whether a defrost was successful in terms of whether a predetermined temperature was reached during a defrosting operation.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. An automatically-defrosting refrigeration apparatus including a refrigerant evaporator, a heater for defrosting said evaporator, and a demand defrost control system, said demand defrost control system comprising:

a defrost control including means for establishing either a relatively shorter or a relatively longer interval between successive defrosting operations, said defrost control further including means for establishing the duration of a defrosting operation;

means for de-energizing said evaporator and energizing said heater upon initiation of a defrosting operation and for de-energizing said heater by at least the end of a defrosting operation;

a thermal sensor responsive to a predetermined evaporator temperature being reached during a defrosting operation; and means responsive to said thermal sensor for selecting the interval before the next defrosting operation, the relatively shorter interval being selected if the predetermined temperature is not reached during a defrosting operation, and the relatively longer interval being selected if the predetermined temperature is reached during a defrosting operation.

2. A refrigeration apparatus according to claim 1, wherein said means for energizing and de-energizing said heater de-energizes said heater whenever the predetermined temperature is reached.

3. A refrigeration apparatus according to claim 2, wherein the relatively shorter interval is approximately six hours, the relatively longer interval is approximately twenty-four hours, the duration of a defrosting operation is approximately twenty minutes, and the predetermined temperature is approximately 50° F.

4. A refrigeration apparatus according to claim 1, which further includes a refrigerated compartment cooled by said evaporator, a refrigerant compressor for energizing said evaporator, and a thermostatic control for maintaining a preset temperature in said compartment by energizing and de-energizing said compressor as required; and wherein said demand defrost control system further comprises means permitting said defrost control to accumulate time only when said thermostatic control is calling for additional cooling by attempting to energize said compressor.

5. A refrigeration apparatus according to claim 2, wherein:

said defrost control comprises a first timer means for establishing the relatively shorter interval and for establishing the duration of a defrosting operation, and a second timer means for establishing the relatively longer interval;

said second timer means includes means for preventing the energization of said heater when said second timer means is running; and said means responsive to said thermal sensor includes means for starting said second timer means whenever the predetermined temperature is reached.

6. A refrigeration apparatus according to claim 4, wherein:

said defrost control comprises a first timer means for establishing the relatively shorter interval and for establishing the duration of a defrosting operation, and a second timer means for establishing the relatively longer interval;

said second timer means includes means for preventing the energization of said heater when said second timer means is running; and said means responsive to said thermal sensor includes means for starting said second timer means whenever the predetermined temperature is reached.

7. A refrigeration apparatus according to claim 2, wherein:

said defrost control comprises a timer means for establishing the relatively shorter interval and for establishing the duration of a defrosting operation, and further comprises a recycling digital count accumulating means having a home condition and at least one travelling condition;

energization of said heater by said timer means being permitted when said digital count accumulating means is in the home condition and prevented when said digital count accumulating means is in a travelling condition;

said means responsive to said thermal sensor includes means for incrementing said digital count accumulating means from the home condition whenever the predetermined temperature is reached;

said recycling digital count accumulating means includes means for incrementing said count accumulating means from any travelling condition to the next condition whenever said timer means calls for a defrosting operation.

8. A refrigeration apparatus according to claim 7, wherein said recycling digital count accumulating means is a recycling stepping switch.

9. A refrigeration apparatus according to claim 4, wherein:

said defrost control comprises a timer means for establishing the relatively shorter interval and for establishing the duration of a defrosting operation, and further comprises a recycling digital count accumulating means having a home condition and at least one travelling condition;

energization of said heater by said timer means being permitted when said digital count accumulating means is in the home condition and prevented when said digital count accumulating means is in a travelling condition;

said means responsive to said thermal sensor includes means for incrementing said digital count accumulating means from the home condition whenever the predetermined temperature is reached;

said recycling digital count accumulating means includes means for incrementing said count accumulating means from any travelling condition to the next condition whenever said timer means calls for a defrosting operation.

10. A refrigeration apparatus according to claim 9, wherein said recycling digital count accumulating means is a recycling stepping switch.

11. The method of controlling the interval between successive evaporator defrosting operations in a refrigeration apparatus, which method comprises:

establishing the duration of a defrost operation;

energizing a heater upon initiation of a defrosting operation and de-energizing the heater at least by the end of the defrosting operation;

sensing the temperature of the evaporator during a defrosting operation;

selecting a relatively shorter interval before the next defrosting operation if a predetermined sensed temperature is not reached during a defrosting operation, and selecting a relatively longer interval before the next defrosting operation if the predetermined sensed temperature is reached during a defrosting operation.

* * * * *